US005180252A

United States Patent [19]

Tanaka et al.

[11] Patent Number: 5,180,252

[45] Date of Patent: Jan. 19, 1993

[54] EARTH PRESSURE SYSTEM SHIELD PROCESS

[75] Inventors: Hiroshi Tanaka; Ryoji Kobayashi, both of Osaka, Japan

[73] Assignees: Kabushiki Kaisha Konoike Gumi, Osaka; Kabushiki Kaisha Komatsu Seisakusho, Tokyo, both of Japan

[21] Appl. No.: 768,981

[22] PCT Filed: Apr. 25, 1990

[86] PCT No.: PCT/JP90/00539

§ 371 Date: Oct. 4, 1991

§ 102(e) Date: Oct. 4, 1991

[87] PCT Pub. No.: WO90/13733

PCT Pub. Date: Nov. 15, 1990

[30] Foreign Application Priority Data

Apr. 28, 1989 [JP] Japan ..... 1-107401
Apr. 28, 1989 [JP] Japan ..... 1-107402

[51] Int. Cl.[5] ..... E21D 9/08

[52] U.S. Cl. ..... 405/144; 299/33; 405/138; 405/141

[58] Field of Search ..... 405/141, 146, 138, 150, 405/143, 144; 299/31, 33

[56] References Cited

U.S. PATENT DOCUMENTS

| | | | |
|---|---|---|---|
| 3,334,945 | 8/1967 | Bartlett | 405/144 X |
| 3,830,545 | 8/1974 | Sugden | 299/33 |
| 4,165,129 | 8/1979 | Sugimoto et al. | 405/141 X |
| 4,848,963 | 7/1989 | Babenderetde et al. | 405/144 |
| 4,915,541 | 4/1990 | Thompson et al. | 405/146 |

FOREIGN PATENT DOCUMENTS

| | | | |
|---|---|---|---|
| 3437996 | 4/1986 | Fed. Rep. of Germany | 405/141 |
| 53-87534 | 8/1978 | Japan . | |
| 55-165397 | 12/1980 | Japan . | |
| 57-29792 | 2/1982 | Japan . | |
| 61-216994 | 9/1986 | Japan . | |
| 1391499 | 4/1975 | United Kingdom | 405/144 |

*Primary Examiner*—Dennis L. Taylor
*Attorney, Agent, or Firm*—Flynn, Thiel, Boutell & Tanis

[57] ABSTRACT

The invention relates to an earth pressure system shield process. First of all, an excavation additive consisting of the mixture of an agent for improving fluidity and viscosity of an excavated soil and a mud improving main agent is added (Ic, $P_2$) to the excavated soil at the time of shield excavation at the working face, inside a mixing chamber (1*b*) of a shield machine (1) and inside a soil discharge screw conveyor (3) to sufficiently mix the excavated soil with the improving main agent and a mud improving assistant agent is then added (5) inside the soil discharge screw conveyor (3), so that the seal covered by the improving main agent so as not to be disssolved in water is removed chemically by this assistant agent. In this manner, the excavated soil is improved to a high quality soil having low fluidity inside the soil discharge screw conveyor (3) and is discharged. As described above, the improving main agent and the improving assistant agent are mixed continuously, and at the same time a cut-off plug zone is formed inside a mixing screw conveyor ($3_3$), and a cylinder portion (15) not having a soil and gravel conveyor means is disposed at the rear end of the conveying screw conveyor ($3_2$) so as to form the cut-off plug, to prevent explosion of the discharged soil, to prevent collapse of the working face and to make the soil discharge work easy.

4 Claims, 4 Drawing Sheets

EARTH PRESSURE SYSTEM SHIELD PROCESS

TECHNICAL FIELD

The present invention relates to a shield-type, underground tunneling process in which the excavated soil is improved and is utilized for effecting shielding of the excavation against the underground pressure of the earth being excavated, particularly to the shield excavation of earth which exerts a high hydraulic pressure on the working face of the excavation, that is, the face of the excavation that is contacted by the cutter.

DESCRIPTION OF THE PRIOR ART

In a conventional shield-type underground tunneling process, in which the working face is stabilized by maintaining pressurized, fluidized, excavated soil in contact with the working face of the excavation. Such a process is hereafter referred to as a soil pressure-type shield process. The following problems because an excavation additive is added at the time of excavation for imparting fluidity and viscosity to the excavated soil.

(a) When the earth has much underground water and a high ground water pressure, the excavated soil and the pressurized ground water are apt to jet from the discharge port of the screw conveyor which is used for discharging the excavated soil, thereby disturbing the earth adjacent to the shield machine. This is liable to cause subsidence or collapse of the earth around the excavation site.

(b) Inasmuch as it is difficult to transport the excavated soil by a dump truck or the like outside the shield construction site due to its high fluidity, it was necessary to improve the excavated soil to eliminate the fluidity therefrom at the shield construction site.

When the excavated soil is jetted from the discharge conveyor, the pressure variation at the working face is restricted to a minimum by providing a rotary valve and the like at the soil discharge port. However, when the hydraulic ground water pressure ranges 2 to 3 kg/cm$^2$, the shield excavation cannot be carried out in the soil pressure-type shield process, but rather, it can be carried out by a muddy water pressure-type shield process. Accordingly, a system other than the soil pressure-type shield process, such as the muddy water pressure-type shield process can be employed.

In order to improve the excavated soil having high fluidity, a soft mud improving agent is added to and mixed with the excavated soil at the shield excavation site so as to eliminate the fluidity.

It is an object of the present invention to provide the soil pressure-type shield process capable of solving such drawbacks described above. The invention makes it possible to excavate soil having high hydraulic pressure without resorting to the large scale and troublesome muddy water pressure-type shield process.

SUMMARY OF THE INVENTION

To achieve the above objects, the soil pressure type shield process for underground tunneling comprises the steps of adding an excavation additive comprising a mixture of (1) an agent for improving the fluidity and viscosity of an excavated soil and (2) a mud-improving main agent, to the excavated soil at the time of shield excavation at the working face, and further mixing the excavated soil and the excavation additive inside the mixing chamber of the shield machine and inside the soil conveying screw conveyor to sufficiently mix the excavated soil with the mud-improving main agent, then adding (3) a mud improving assistant inside the soil discharge screw conveyor so that the excavated soil is improved to become a high quality soil inside the soil conveying screw conveyor. As a result, the excavated soil can be mixed with the excavation additive and improved sufficiently even if a shield machine having a small diameter is employed. The improved, high-quality soil is continuously conveyed toward the rear end of a conveying screw conveyor by a screw provided in the conveying screw conveyor and a mixing screw conveyor and is filled under high pressure into the rear end of the conveying screw conveyor. A cut-off plug zone is formed by a cylinder portion having no soil and gravel conveyor means, which cylinder portion is disposed at the rear end of the conveying screw conveyor. As a result, the soil pressure-type shield process, according to the present invention, makes it possible to use the shield construction to excavate earth having a high underground hydraulic pressure.

DETAILED DESCRIPTION

An embodiment of the present invention will be described in detail with reference to drawings.

Figure 1:
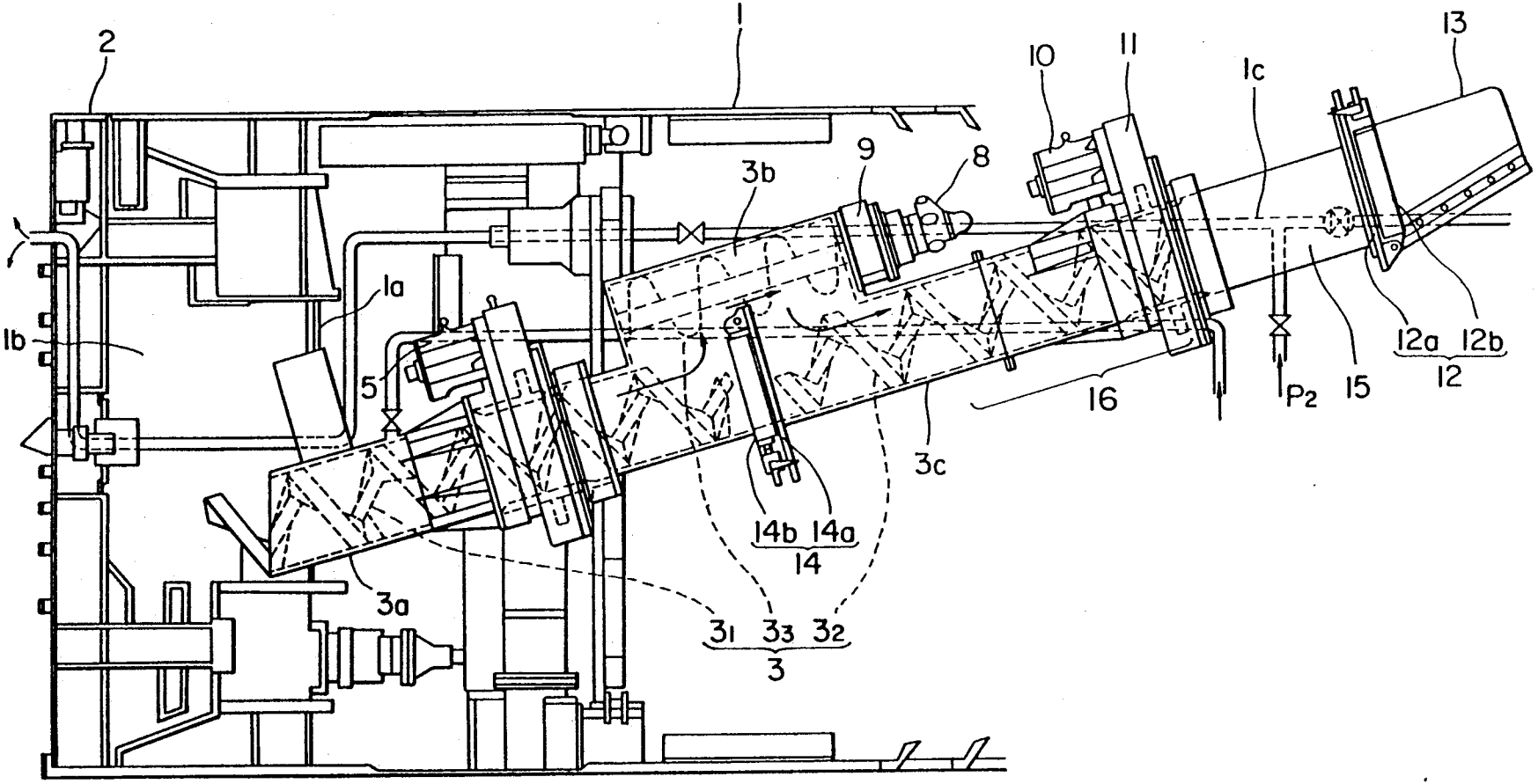
FIG. 1(*a*) is a cross sectional view of a shield machine employing the soil pressure-type shield process for excavating a tunnel according to an embodiment of the present invention, FIG. 1(*b*) is a schematic view for explaining FIG. 1(*a*)
Figure 1B:
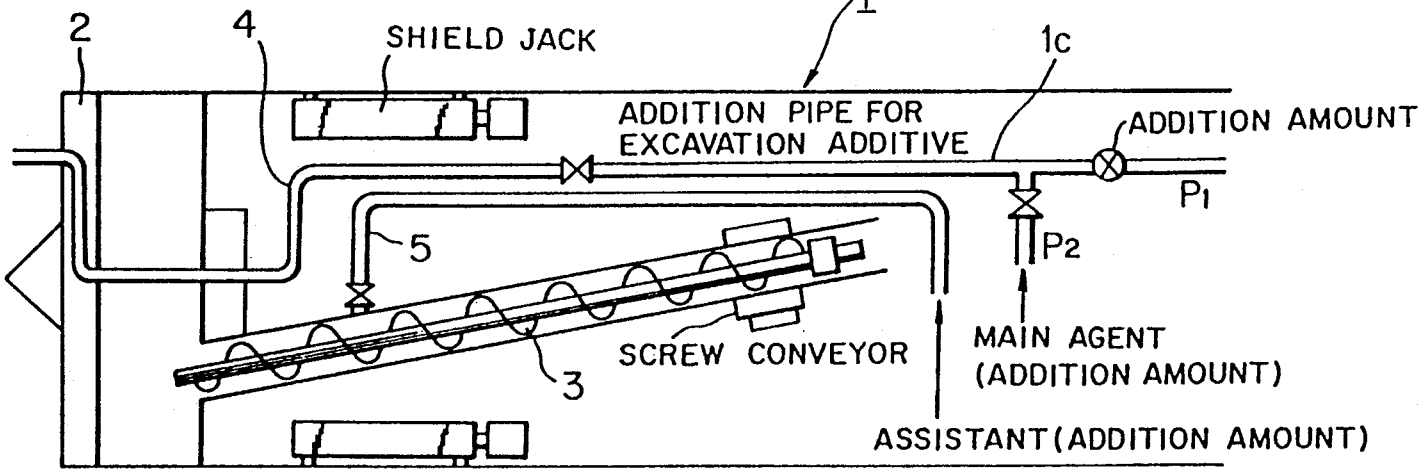

Referring to FIGS. 1(*a*) and 1(*b*), 1 is a shield-type, underground tunneling machine, 2 is a rotary cutter head provided at the front of the shield-type tunneling machine for cutting and excavating the soil by the rotation thereof. The cutter head also includes means for discharging therefrom an excavation additive for improving the fluidity and viscosity, that is, a so-called excavation additive composed of bentonite, clay, water and the like. 1*b* is a mixing chamber for introducing the excavated soil thereinto and mixing the excavated soil with the excavation additive introduced thereinto from an excavation additive introduction tube to thereby fluidify the resultant mixture.

The excavation additive is manufactured outside the shield pit. The excavation additive is conveyed inside the shield pit by a pump p1 passes through an excavation additive introduction pipe 1*c*, thence though the conveying pipe 4 and is then introduced into the earth by the cutter head 2 and thereafter is mixed with the excavated soil in the mixing chamber 1*b*.

A mud-improving main agent in the form of slurry is conveyed by the pump p2 into the pipe 1*c*, then through the conveying pipe 4 and mixed with the excavated soil. The amount of mud-improving main agent supplied depends on the excavation speed of the shield machine 1, i.e. the amount of the excavated soil and the nature of the excavated soil. The resultant mixture (1) of the agent for improving the fluidity and viscosity of the excavated soil, and (2) the mud-improving main agent is introduced into the working face of the excavation and is mixed with the excavated soil in the mixing chamber 1*b* so that the agent for improving the fluidity and viscosity mud-improving main agent are uniformly dispersed into the excavated soil.

The mud-improving main agent can be mixed with the agent to improve fluidity and viscosity to make the excavation additive at the excavation additive mud manufacturing plant located outside the shield pit or it can be mixed with water at the back of the shield machine 1 and formed into a slurry and introduced into the excavation agent introduction pipe 1*c* through the introduction pump p2.

When the mud-improving main agent is introduced into the working face of the excavation, the mud-improving main agent can be introduced through the excavation additive introduction pipe 1*c* or through an independent introduction pipe provided in the shield machine 1 separately from the introduction pipe 1*c*.

The introduction pump p2 is operated in response to the excavation speed of the shield machine 1 and adjusts the amount of the mud-improving main agent to be supplied therefrom and has a regulator, not shown, capable of introducing at the proper ratio to the excavated soil.

The mud-improving main agent comprises a chemical for improving the soil by introducing into and mixing with the mud, e.g., a coagulant composed of a natural vegetable chemical such as "ERFRESH" (Japanese Trade Mark Registration No. 2,304,178 owned by one of the assignees of the present application) as a main ingredient. The surface of the mud-improving main agent is sealed so as not to be dissolved in water.

As set forth above, the excavated soil is mixed with the excavation additive in the mixing chamber 1*b* and is formed as a mud having high fluidity and viscosity. The mud is drawn rearward by the soil discharge screw conveyor 3. The soil discharge screw conveyor 3 comprises a first conveying screw conveyor $3_1$, having a shutter 14 at its upper end, a second conveying screw conveyor $3_2$ and a mixing screw conveyor $3_3$ disposed over the shutter 14 and communicating with the adjacent ends of the first and the second conveying screw conveyors $3_1$ and $3_2$ and bypassing the shutter.

The first conveying screw conveyor $3_1$ is housed in a cylindrical case 3*a* having a tip end portion which opens into the shield chamber 1*b*. A hole for communicating with the mud-improving assistant agent introduction pipe 5 is provided rearwardly of the separated wall 1*a* over and above the case 3*a*. The mud-improving assistant agent has a function to chemically remove the seal that covers the mud-improving main agent. When the mud-improving assistant agent is introduced into the soil discharge screw conveyor 3 from the mud-improving assistant agent introduction port 5 and is added to the mud in the proper proportion to the conveying amount of the mud, the mud-improving assistant agent is mixed with the mud in the screw conveyor 3, thereby causing the fluidity of the mud to be decreased.

Figure 2:
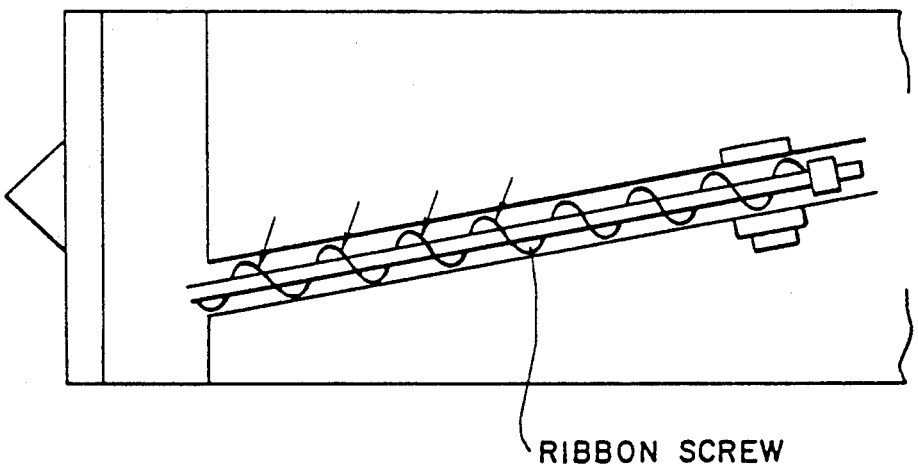
FIG. 2 is a schematic view for explaining another embodiment and FIG. 3 is a block diagram showing a control system.

The mixing of the mud-improving assistant agent with the mud can be made by the first conveying screw conveyor $3_1$ alone when no second conveying screw conveyor $3_2$ is installed. If the soil discharge screw conveyor is composed of a ribbon screw conveyor, the position of the introduction port can be changed appropriately as shown in FIG. 2 so that the mixing ratio can be regulated. If the screw conveyor is composed of a screw conveyor having a shaft attached thereto, the mixing can be made by providing a mixing assistant screw.

The shutter 14 comprises a closing cylinder 14*b* provided at both sides thereof and a shutter plate 14*a* which is vertically closable by the closing cylinder 14*b*. When the shutter plate 14*a* is closed, the soil conveyed by the first conveying screw conveyor $3_1$ is blocked by the shutter plate 14*a* and is introduced into the mixing screw conveyor $3_3$.

The mixing screw conveyor $3_3$ facilitates the solidification of the mud by mixing the excavated soft mud having high a fluidity, but not yet sufficiently solidified by the first conveying screw conveyor $3_1$, with the soil improving agent and forms a cut-off plug zone by compressing the soil. The mixing screw conveyor $3_3$ is rotatably driven by a drive motor 8 provided at the rear end of the case 3*b* through a reduction gear 9 to thereby form the cut-off plug zone inside the case 3*b* by the operation described later.

The soil mixed sufficiently with the soil improving agent by the mixing screw conveyor $3_3$ and solidified thereby is fed into the case 3*c* of the second conveying screw conveyor $3_2$.

The second conveying screw conveyor $3_2$ is rotatably driven by a drive motor 10 provided at the rear end portion of the case 3*c* through a reduction gear 11 so that the solidified soil is conveyed in the rearward direction of the case 3*c*.

The mixing of the soil with the soil improving agent and the conveyance of the resultant mixture are successively made by the first conveying screw conveyor $3_1$, the mixing screw conveyor $3_3$ and the second conveying screw conveyor $3_2$ so that the improved soil is successively compressed and filled in the rear portion 16 of the second conveying screw conveyor $3_2$, thereby forming the cut-off plug zone for resisting the hydraulic pressure influencing the working face. To form the cut-off plug zone, a cylinder portion 15 having no conveyor means for soil and gravel, is provided at the rear end portion of the second conveying screw conveyor $3_2$ so that the excavated soil is discharged from the end portion of the cylinder portion 15.

A shutter 12 is provided at the rear end of the case 3*c* and comprises a closing cylinder 12*b* and a shutter plate 12*a* which is vertically closable by the closing cylinder 12*b*.

A hopper 13 protrudes from the rear side of the shutter 12. The soil conveyed by the second conveying screw conveyor $3_2$ drops on a conveying vehicle, such as a truck or a belt conveyor, for discharging the soil by way of the hopper 13 when the shutter 12 is open.

The cylinder portion 15 resists the conveyance of the soil and has a function to compress and fill the improved soil into the rear portion 16 of the second conveying screw conveyor $3_2$ with assurance. The resistance of the cylinder portion 15 against the conveyance of the soil can be regulated by regulating the length of the cylinder portion 15 or gradually reducing the cross-sectional area of the cylinder portion 15 toward the rear portion thereof. Inasmuch as the cut-off plug zone is formed, the soil, improved by the excavation additive, is recovered in a density corresponding to the state before the excavation additive is mixed with the soil so that the cylinder portion 15 can resist the hydraulic pressure influencing the working face with the shearing resistance possessed by the soil and the blades of the screw conveyor.

If the shearing resistance is insufficient, a fibrous shearing resistance reinforcing member can be added to the soil.

Figure 3:
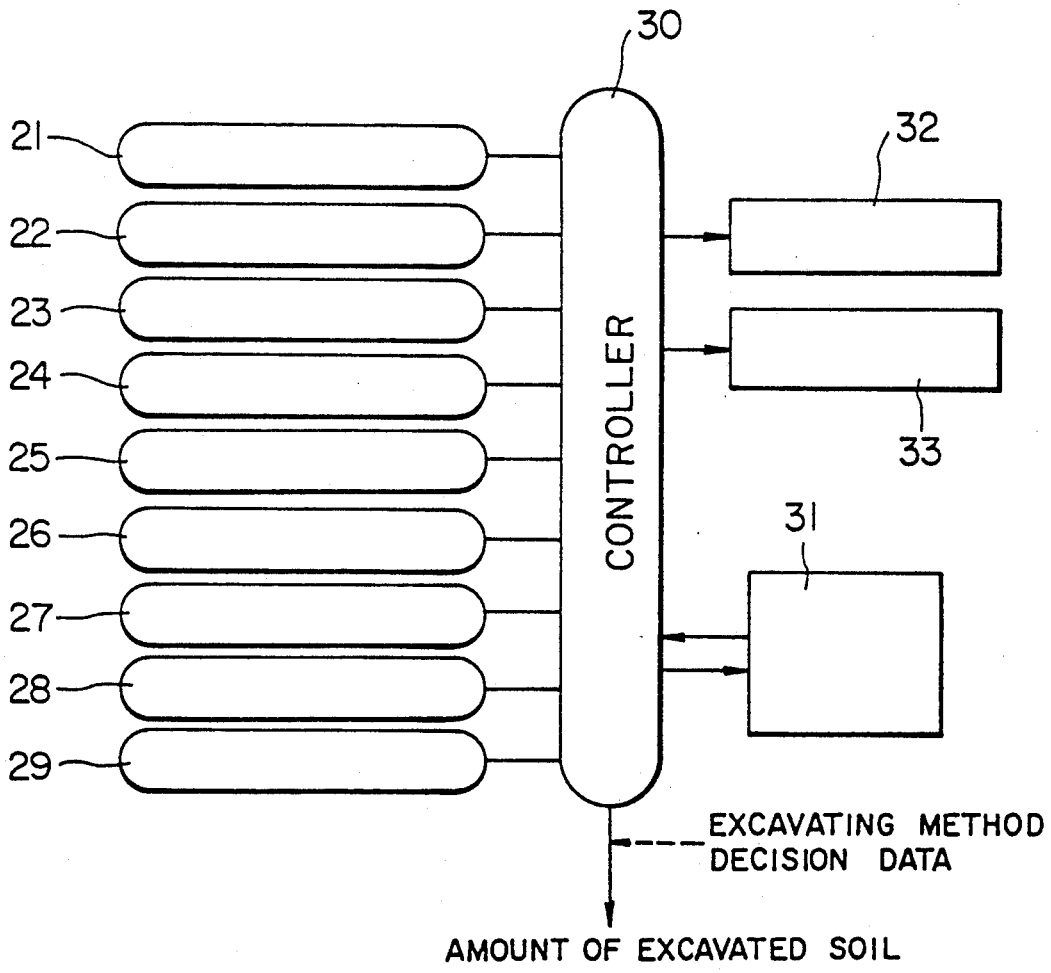

FIG. 3 is a block diagram showing a measuring control procedure in which there are supplied to a controller 30 input signals from a shield jack stroke detector 21, a shield jack speed detector 22, a screw conveyor rpm detector 23, a screw conveyor torque detector 24, a discharge soil flowing speed detector 25, a discharge soil density detector 26, an excavation additive addition amount measuring device 27, a mud-improving main agent addition amount measuring device 28 and a mud-improving assistant agent addition amount measuring device 29. The controller 30 supplies data into or receives the data from a memory 31 so that the addition amounts of the mud-improving main agent 32 and the mud-improving assistant agent 33 are determined. The addition of the mud-improving main agent is controlled in interlocking relation with the shield jack speed while the addition of the mud-improving assistant agent is controlled in interlocking relation with the rpm of the screw or the measured discharged amount of the soil.

The addition amounts of the mud improving main agent and the mud-improving assistant agent are regulated by measuring and deciding whether the improvement of the excavated mud and the formation of the cut-off plug zone are respectively made or not in the soil discharge screw conveyors while the discharge amount of the soil from the soil discharge screw conveyors are measured, thereby deciding as to whether an excessive excavation made at the working face disturbs the earth at the periphery of the working face.

Accordingly, it is possible to effect the determined mixture of the soil and the excavation additive and the improvement of the soil by the shield machine having a small diameter without adding a specific mixer thereto since the mud and the mud-improving main agent are sufficiently mixed in the cutter chamber and the seal of the mud-improving main agent is removed by the mud-improving assistant agent in the soil discharge screw conveyor.

According to the present invention, an excavation additive consisting of a mixture of the agent for improving fluidity and viscosity of excavated soil and the mud-improving main agent is added to the excavated soil at the time of shield excavation at the working face, inside the mixing chamber of the shield machine and inside the discharge screw conveyor, thereby sufficiently mixing the excavated soil with the improving main agent. Thereafter, the seal covering the improving main agent is removed chemically by the mud-improving assistant added to the mud in the soil discharge screw conveyor. Inasmuch as the excavated soil is improved into a high quality soil having low fluidity inside the soil discharge screw conveyor, it is possible to effect a sufficient mixture of the soil and the excavation additive and the improvement of the soil by the shield machine having a small diameter without providing a specific mixer.

Furthermore, according to the present invention, the mud-improving main agent and the mud-improving assistant are mixed with each other continuously, and at the same time the cut-off plug zone is formed inside the discharge screw conveyor for resisting the hydraulic pressure influencing the shielded front portion, thereby preventing the jetting of the discharged soil, to preventing collapse of the working face and making the soil discharge work easy.

Furthermore, it is possible to recover the soil improved by one improved agent in density at the state before the excavation additive is added to the soil by providing the cylinder portion having no conveyor means for soil and gravel at the rear end portion of the soil screw conveyor. The cut-off plug is formed by the improved soil at the rear half portion of the conveying screw conveyor for resisting the hydraulic pressure influencing the working face so that the shearing resistance possessed by the soil and the blade of the screw conveyors can sufficiently resist the hydraulic pressure influencing the working face, thereby preventing the jetting of the discharged soil.

Accordingly, according to the present invention, it is not necessary to employ the soil pressure system shield process at the time of excavation of the soil having the high hydraulic pressure.

Furthermore, there are the excellent advantages that it is possible to prevent the collapse of the working face and the disturbance of the earth at the periphery of the working face at the time of excavation of the soil by the soil pressure-type shield process and to discharge the soil with ease.

We claim:

1. In an underground tunneling process, which comprises excavating underground soil from the working face of an underground tunnel excavation, discharging a mud comprised of excavated soil and water into a mixing chamber and then feeding the mud through a soil discharge screw conveyor to a location spaced from said working face and said mixing chamber, the improvement which comprises;

feeding into the region of said working face an excavation additive comprising (1) an agent for improving the fluidity and viscosity of the excavated soil and (2) a mud-improving main agent effective to coagulate the soil, said mud-improving main agent that is fed into said region being coated with a water-insoluble coating so that it is not effective to coagulate the soil in said region, said excavation additive being uniformly dispersed in said mud in said region, in said mixing chamber and in said soil discharge screw conveyor to form a mud having high fluidity and viscosity; then adding to and mixing with the mud that is being moved through said soil discharge screw conveyor (3) a mud-improving assistant agent effective to chemically remove the water-insoluble coating on said mud-improving main agent whereby said mud-improving main agent then becomes effective to coagulate the excavated soil to convert same into a high quality, coagulated soil.

2. In an underground tunneling process, which comprises excavating underground soil from the working face of an underground tunnel excavation, discharging a mud comprised of excavated soil and water into a mixing chamber and then feeding the mud through a soil discharge screw conveyor to a location spaced from said working face and said mixing chamber, the improvement which comprises;

feeding into the region of said working face an excavation additive comprising (1) an agent for improving the fluidity and viscosity of the excavated soil and (2) a mud-improving main agent, said mud-improving main agent that is fed into said region being coated with a water-insoluble coating so that it is not effective to improve the mud in said region, said excavation additive being uniformly dispersed in said mud in said region, in said mixing chamber and in said soil discharge screw conveyor to form a mud having high fluidity and viscosity; then adding to end mixing with the mud that is being moved through said soil discharge screw conveyor (3) a mud-improving assistant agent effective to chemically remove the water-insoluble coating on said mud-improving main agent whereby said mud-improving main agent then becomes effective to convert the excavated soil into a high quality soil having a decreased fluidity.

3. A process according to claim 2, wherein the mud-improving main agent and the mud-improving assistant agent are mixed inside the soil discharge screw conveyor and a cut-off plug zone is formed to maintain the hydraulic pressure acting on the working face of the underground tunnel excavation.

4. A process according to claim 2, wherein a cylinder portion, free of conveyor means, is disposed at the rear end of the soil discharge screw conveyor so as to form a cut-off plug and enable the excavation at the working face to be performed under a high hydraulic pressure.

* * * * *

UNITED STATES PATENT AND TRADEMARK OFFICE

CERTIFICATE OF CORRECTION

PATENT NO. : 5 180 252

DATED : January 19, 1993

INVENTOR(S) : Hiroshi Tanaka et al

It is certified that error appears in the above-identified patent and that said Letters Patent is hereby corrected as shown below:

Column 6, line 28; change "comprises;" to ---comprises:---.
line 56; change "comprises;" to ---comprises:---.
line 68; change "end" to ---and---.

Signed and Sealed this

Fourth Day of January, 1994

Bruce Lehman

*Attest:*

BRUCE LEHMAN

*Attesting Officer*

*Commissioner of Patents and Trademarks*